US012678915B2

(12) United States Patent
Kwon et al.

(10) Patent No.: US 12,678,915 B2
(45) Date of Patent: Jul. 14, 2026

(54) SUBSTRATE PROCESSING APPARATUS AND SUBSTRATE PROCESSING METHOD

(71) Applicant: SAMSUNG ELECTRONICS CO., LTD., Suwon-si (KR)

(72) Inventors: Donghoon Kwon, Suwon-si (KR); Boun Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 399 days.

(21) Appl. No.: 18/127,382

(22) Filed: Mar. 28, 2023

(65) Prior Publication Data

US 2024/0100647 A1 Mar. 28, 2024

(30) Foreign Application Priority Data

Sep. 26, 2022 (KR) ..... 10-2022-0121733

(51) Int. Cl.
*B24B 37/20* (2012.01)
*B24B 37/04* (2012.01)
*B24B 57/02* (2006.01)

(52) U.S. Cl.
CPC ..... *B24B 37/205* (2013.01); *B24B 37/044* (2013.01); *B24B 57/02* (2013.01)

(58) Field of Classification Search
CPC ..... B24B 37/00; B24B 37/005; B24B 37/04; B24B 37/042; B24B 37/044; B24B 37/07;
(Continued)

(56) References Cited

U.S. PATENT DOCUMENTS 6,071,177 A * 6/2000 Lin ..... B24B 37/013 438/692
6,153,043 A 11/2000 Edelstein et al.
(Continued)

FOREIGN PATENT DOCUMENTS

CN 110744362 A 2/2020
JP 2001308041 A 11/2001
(Continued)

OTHER PUBLICATIONS

Translation of KR 20090056633 A (Year: 2009).*
Translation of JP 2004342640 A (Year: 2004).*

*Primary Examiner* — Joel D Crandall
*Assistant Examiner* — Steven Huang
(74) *Attorney, Agent, or Firm* — Sughrue Mion, PLLC

(57) ABSTRACT

A substrate processing apparatus includes a substrate support portion including a platen and a transparent polishing pad on the platen, the platen comprising a light generator that generates light that passes through the transparent polishing pad and proceeds towards a semiconductor substrate on the substrate support portion, and the transparent polishing pad including a surface that contacts and polishes the semiconductor substrate. The substrate processing apparatus further includes: a substrate holder that fixes the semiconductor substrate such that the semiconductor substrate is in contact with the substrate support portion; and a slurry supply portion that supplies slurry between the semiconductor substrate and the transparent polishing pad. The slurry includes a light blocking material that blocks the light; and abrasive particles that are configured to be activated by accepting electrons generated, based on the light, by a photocatalyst within the slurry.

20 Claims, 7 Drawing Sheets

(58) Field of Classification Search
CPC ..... B24B 37/10; B24B 37/205; B24B 37/34; B24B 49/00; B24B 49/08; B24B 49/12; B24B 57/02; B24B 7/228; C09G 1/02; C09K 3/1436
See application file for complete search history.

(56) References Cited

U.S. PATENT DOCUMENTS 6,364,744 B1 4/2002 Merchant et al.
6,887,816 B2 5/2005 Tanaka et al.
7,052,367 B2 5/2006 Kimura et al.
8,734,661 B2 5/2014 Yamauchi et al.
9,754,845 B2 9/2017 Liu
2003/0022502 A1* 1/2003 Matsui ..... C09G 1/02 438/692
2003/0114076 A1* 6/2003 Chang ..... B24B 37/205 451/6
2004/0014395 A1* 1/2004 Birang ..... B24B 51/00 451/6
2006/0020419 A1* 1/2006 Benvegnu ..... B24B 37/013 702/172
2008/0190894 A1* 8/2008 Yu ..... C09G 1/02 252/79.1
2008/0194183 A1* 8/2008 Fujii ..... C09G 1/02 451/36
2013/0196513 A1* 8/2013 Kubota ..... H10P 50/642 438/746
2017/0136602 A1* 5/2017 Hou ..... B24B 37/20
2018/0229343 A1* 8/2018 Kim ..... H01L 21/67248
2020/0032104 A1* 1/2020 Nakagawa ..... C23C 14/028
2024/0189959 A1* 6/2024 Namiki ..... B24B 37/013

FOREIGN PATENT DOCUMENTS

JP 2003238941 A 8/2003
JP 2004342640 A * 12/2004
KR 20090056633 A * 6/2009 ..... B24B 37/205

* cited by examiner

SUBSTRATE PROCESSING APPARATUS AND SUBSTRATE PROCESSING METHOD

CROSS-REFERENCE TO THE RELATED APPLICATION

This application claims priority under 35 U.S.C. § 119 to Korean Patent Application No. 10-2022-0121733, filed on Sep. 26, 2022, in the Korean Intellectual Property Office (KIPO), the contents of which are herein incorporated by reference in their entirety.

BACKGROUND

1. Field

Example embodiments of the present disclosure relate to a substrate processing apparatus and a substrate processing method. More particularly, example embodiments or the present disclosure relate to a substrate processing apparatus for performing a polishing process on a semiconductor substrate and a substrate processing method using the same.

2. Description of the Related Art

In a chemical mechanical polishing (CMP) process for polishing one surface of a semiconductor substrate, factors such as pressure, speed, and temperature may be controlled to improve polishing performance. As development difficulty of semiconductor products increases, a uniform polishing degree is required for semiconductor substrates. A surface of the semiconductor substrate may have a fine uneven structure. During a polishing process, a difference in a contact ratio may occur between the substrate support and the semiconductor wafer by the fine uneven structure of semiconductor substrates, which may cause a problem of reducing polishing performance.

SUMMARY

Example embodiments of the present disclosure provide a substrate processing apparatus using slurry activated at protrusions of a semiconductor wafer to provide a uniform polishing degree for the semiconductor wafer.

Example embodiments of the present disclosure provide a substrate processing method of using the substrate processing apparatus.

According to embodiments of the present disclosure, a substrate processing apparatus is provided. The substrate processing apparatus includes: a substrate support portion including a platen and a transparent polishing pad on the platen, the platen including a light generator configured to generate light that passes through the transparent polishing pad and proceeds towards a semiconductor substrate on the substrate support portion, and the transparent polishing pad including a surface that is configured to contact and polish the semiconductor substrate; a substrate holder configured to fix the semiconductor substrate such that the semiconductor substrate is in contact with the substrate support portion, and the substrate holder is further configured to contact the surface of the transparent polishing pad and the semiconductor substrate, and polish the semiconductor substrate via the transparent polishing pad; and a slurry supply portion configured to supply slurry between the semiconductor substrate and the transparent polishing pad, wherein the slurry includes: a light blocking material that is configured to block the light; and abrasive particles that are configured to be activated by accepting electrons generated, based on the light, by a photocatalyst within the slurry.

According to embodiments of the present disclosure, a substrate processing apparatus is provided. The substrate processing apparatus includes: a platen including a light generator configured to generate light, and an optical window configured to allow the light to pass therethrough; a transparent polishing pad on the platen, the transparent polishing pad including an upper surface configured to contact and polish a semiconductor substrate, wherein the light generator is configured to generate the light such that the light passes through the transparent polishing pad and proceeds towards the semiconductor substrate; a substrate holder configured to fix the semiconductor substrate on the transparent polishing pad and press the semiconductor substrate onto the upper surface of the transparent polishing pad; a slurry supply portion configured to supply slurry between the semiconductor substrate and the transparent polishing pad, the slurry including a light blocking material that is configured to block the light, and the slurry further including abrasive particles that are configured to be activated by accepting electrons generated, based on the light, by a photocatalyst within the slurry; and a pad conditioner configured to distribute the slurry in a horizontal direction on the transparent polishing pad.

According to embodiments of the present disclosure, a substrate processing apparatus is provided. The substrate processing apparatus includes: a substrate support portion that includes a platen and a transparent polishing pad on the platen, the platen including a light generator configured to generate light that passes through the transparent polishing pad and proceeds towards a semiconductor substrate on the substrate support portion, and the transparent polishing pad including a surface that is configured to contact and polish the semiconductor substrate; a substrate holder configured to fix the semiconductor substrate such that the semiconductor substrate is in contact with the substrate support portion, and the substrate holder is further configured to contact the surface of the transparent polishing pad and the semiconductor substrate, and polish the semiconductor substrate via the transparent polishing pad; a slurry supply portion configured to supply slurry between the semiconductor substrate and the transparent polishing pad, the slurry including a light blocking material that is configured to block the light, and the slurry further including abrasive particles that are configured to be activated by electrons generated, based on the light, by a photocatalyst within the slurry; and a pad conditioner configured to dispense the slurry on the substrate support portion and roughen the surface of the transparent polishing pad to maintain the transparent polishing pad with a constant surface roughness capable of polishing the semiconductor substrate, wherein the abrasive particles further comprise cerium oxide ($CeO_2$), and the abrasive particles are configured to be activated by the electrons generated by the photocatalyst such that tetravalent cerium ions ($Ce^{4+}$) on a surface of the cerium oxide are reduced to trivalent cerium ions ($Ce^{3+}$).

According to embodiments of the present disclosure, the slurry may fill between the protrusions of the semiconductor substrate where a bottom surface of the semiconductor substrate is located. The light blocking material of the slurry may block the light between the substrate support portion and the semiconductor substrate. Since the light is blocked by the light blocking material, the abrasive particles of the slurry may be non-activated. When the abrasive particles are non-activated, the abrasive particles may not polish the lower surface of the semiconductor substrate on the lower surface of the uneven structure.

According to embodiments of the present disclosure, since surfaces (e.g., bottom surfaces) of the protrusions of the uneven structure directly contact the substrate support portion, the light blocking material may not be provided on such surfaces of the protrusions. Since such surfaces of the protrusions do not have the light blocking material thereon, the photocatalysts located on the protrusions may generate electrons by the light and the abrasive particles (that is, the activated abrasive particles) may polish the protrusions. Accordingly, the abrasive particles in the slurry may polish the surfaces of the protrusions of the uneven structure and not polish the bottom surface of the semiconductor substrate that is between the protrusions. Since the abrasive particles in the slurry polish only the protrusions of the semiconductor substrate, a uniform polishing degree may be generated on the lower surface of the semiconductor substrate.

BRIEF DESCRIPTION OF DRAWINGS

Example embodiments of the present disclosure will be more clearly understood from the following detailed description taken in conjunction with the accompanying drawings. FIGS. 1 to 34 represent non-limiting, example embodiments as described herein.

FIG. 1 is a perspective view illustrating a substrate processing apparatus in accordance with example embodiments of the present disclosure.

FIG. 2 is a front view illustrating a substrate processing apparatus in FIG. 1.

FIG. 3 is an enlarged cross-sectional view illustrating portion in FIG. 2.

FIG. 4 is a first cross-sectional view illustrating a substrate processing method using the substrate processing apparatus in FIG. 1 in accordance with example embodiments of the present disclosure.

FIG. 5 is a second cross-sectional view illustrating the substrate processing method using the substrate processing apparatus in FIG. 1 in accordance with example embodiments of the present disclosure.

FIG. 6 is a third cross-sectional view illustrating the substrate processing method using the substrate processing apparatus in FIG. 1 in accordance with example embodiments of the present disclosure.

FIG. 7 is a fourth cross-sectional view illustrating the substrate processing method using the substrate processing apparatus in FIG. 1 in accordance with example embodiments of the present disclosure.

FIG. 8 is an fifth cross-sectional view illustrating the substrate processing method using the substrate processing apparatus in FIG. 1 in accordance with example embodiments of the present disclosure.

DETAILED DESCRIPTION

Hereinafter, non-limiting example embodiments of the present disclosure will be explained in detail with reference to the accompanying drawings.

It will be understood that when an element or layer is referred to as being "on," "connected to," or "coupled to" another element or layer, it can be directly on, connected to, or coupled to the other element or layer or intervening elements or layers may be present. In contrast, when an element or layer is referred to as being "directly on," "directly connected to," or "directly coupled to" another element or layer, there are no intervening elements or layers present.

Figure 1:
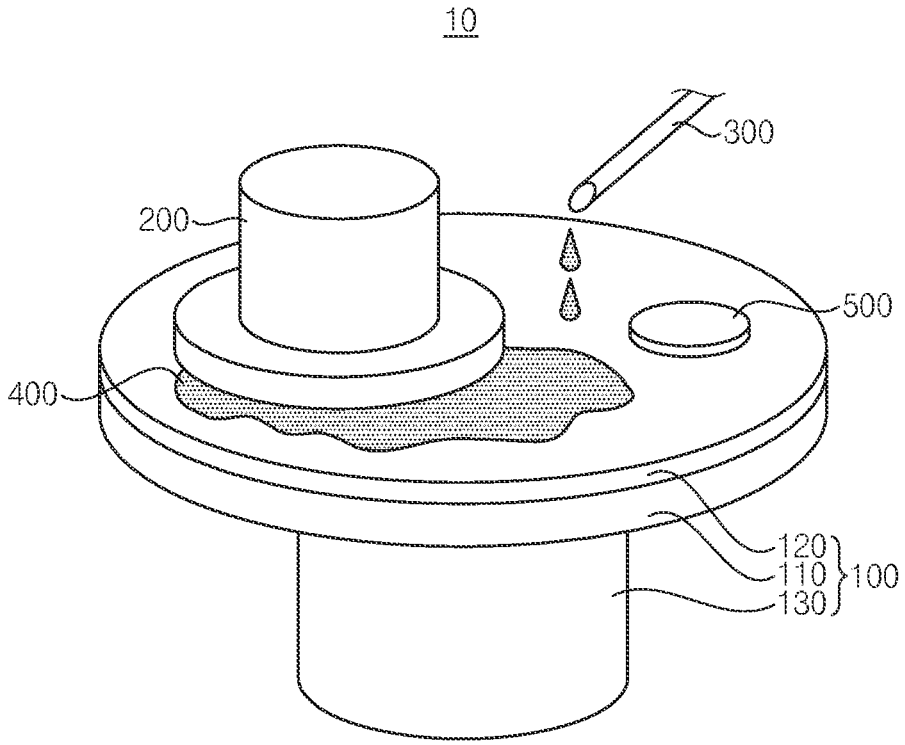
Figure 2:
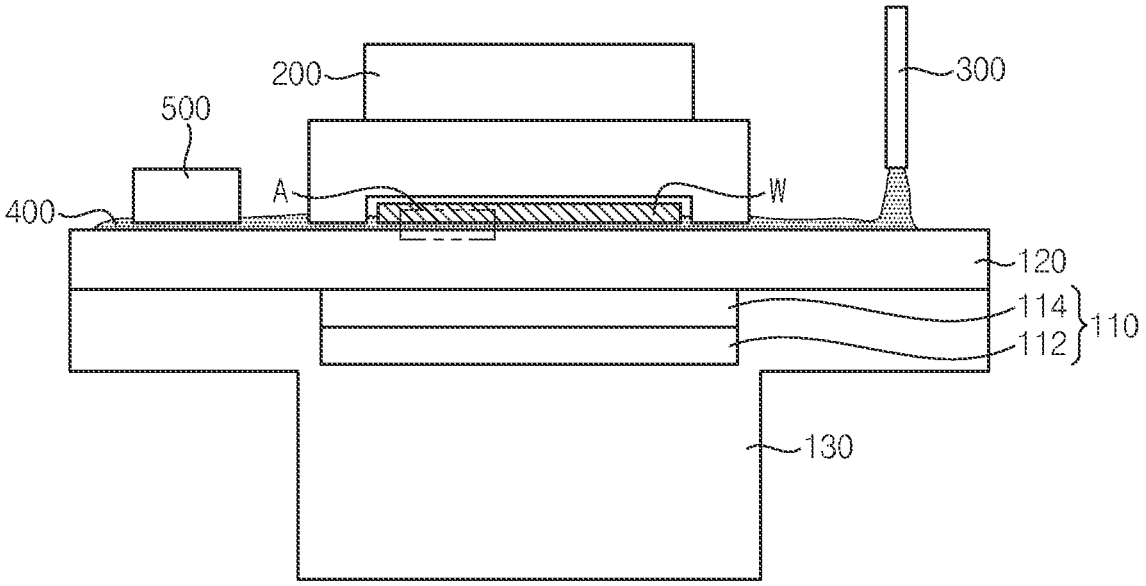
Figure 3:
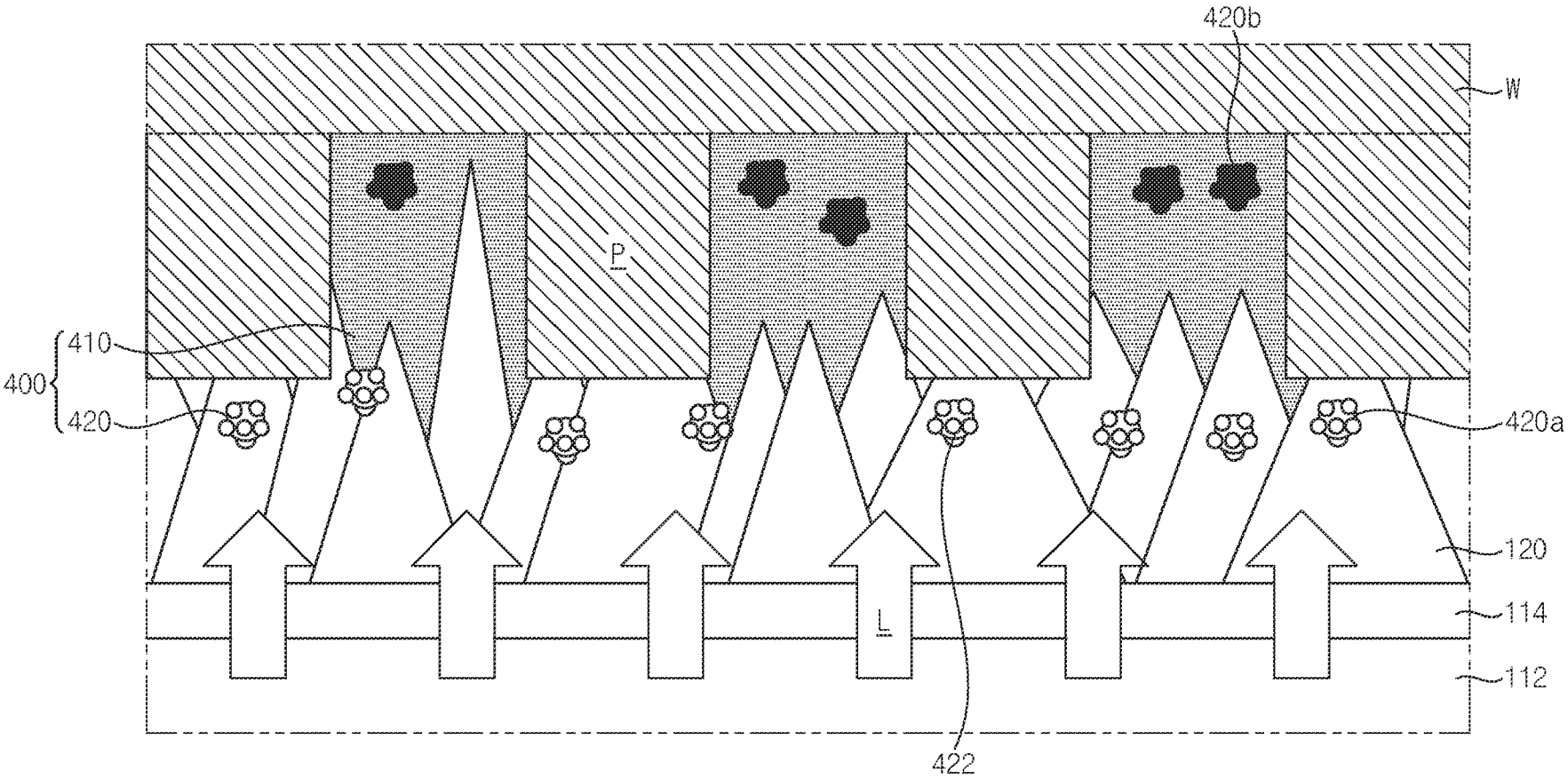

FIG. 1 is a perspective view illustrating a substrate processing apparatus in accordance with example embodiments of the present disclosure. FIG. 2 is a front view illustrating a substrate processing apparatus in FIG. 1. FIG. 3 is an enlarged cross-sectional view illustrating portion A in FIG. 2.

Referring to FIGS. 1 to 3, a substrate processing apparatus 10 may include a substrate support portion 100 supporting a semiconductor substrate W, a substrate holder 200 holding and fixing the semiconductor substrate W on the substrate support portion 100 so as to be detachably attached to the semiconductor substrate W, and a slurry supply portion 300 supplying slurry 400 between the semiconductor substrate W and the substrate support portion 100.

The substrate processing apparatus 10 may be referred to as a device for partially removing one surface of the semiconductor substrate W by a grinding process such as a chemical mechanical polishing (CMP) process. The substrate processing apparatus 10 may reduce a thickness of the semiconductor substrate W to a desired thickness. For example, the semiconductor substrate W may include a wafer.

The semiconductor substrate W may have an uneven structure on its lower surface. The uneven structure of the semiconductor substrate W may be defined by a plurality of protrusions P protruding from the lower surface. The substrate processing apparatus 10 may perform a uniform degree of polishing on the lower surface of the semiconductor substrate W by polishing the protrusions P of the semiconductor substrate W through a polishing process.

In example embodiments, the substrate support portion 100 may include a platen 110 having a light generator 112 configured to generate light L, a transparent polishing pad 120 provided on the platen 110, and a shaft 130 supporting the platen 110. In the polishing process, the semiconductor substrate W may be arranged on an upper surface of the transparent polishing pad 120.

The platen 110 may include the light generator 112 configured to generate the light L, and an optical window 114 passing the light L. The shaft 130 may support a lower surface of the platen 110. The platen 110 may rotate clockwise or counterclockwise via the shaft 130.

The light generator 112 may radiate the light L having a predetermined wavelength to the transparent polishing pad 120 through the optical window 114. The light L may pass through the optical window 114 and the transparent polishing pad 120, and the light L may be irradiated to the lower surface of the semiconductor substrate W. For example, the light generator 112 may include a lamp or an optical fiber. The light generator 112 may be provided adjacent to the transparent polishing pad 120 to radiate light L to the lower surface of the semiconductor substrate W. The light generator 112 may uniformly radiate the light L to the lower surface of the semiconductor substrate W.

For example, the light may include visible light and/or ultraviolet light. The light of the predetermined wavelength may include ultraviolet (UV), visible light, infrared ray (Mid-IR), near-infrared ray (Near-IR), far-infrared ray (Far-IR), and/or terahertz (THz) rays.

The optical window 114 may be provided to pass the light L. The optical window 114 may protect the light generator 112 from external impact. The optical window 114 may include a material capable of passing the light L. For example, the optical window 114 may include a material such as glass, quartz, fused silica, and/or sapphire.

The transparent polishing pad 120 may be provided on the platen 110, and may arrange the semiconductor substrate W on the upper surface thereof. In the polishing process, the semiconductor substrate W may be arranged on the upper surface of the transparent polishing pad 120. In the polishing process, the lower surface of the semiconductor substrate W and the upper surface of the transparent polishing pad 120 may directly contact each other. The transparent polishing pad 120 may have a predetermined surface roughness due to fine uneven shapes on the upper surface thereof. The predetermined surface roughness may be a level capable of polishing the lower surface of the semiconductor substrate W.

The transparent polishing pad 120 may contact at least a portion of the lower surface of the semiconductor substrate W through the uneven shapes. At least some of the uneven shapes may contact the semiconductor substrate W between the semiconductor substrate W and the transparent polishing pad 120. For example, the uneven shapes directly contact the protrusions P of the semiconductor substrate W, and the uneven shapes may not contact a bottom surface of the uneven structure of the semiconductor substrate W that is between the protrusions P.

The transparent polishing pad 120 may rotate by receiving rotational force from the shaft 130 together with the platen 110. The transparent polishing pad 120 may rotate clockwise or counterclockwise by the shaft 130. The transparent polishing pad 120 may evenly apply the slurry 400 on the transparent polishing pad 120 through the rotational force. The transparent polishing pad 120 may generate frictional force with respect to the semiconductor substrate W by the rotational force. The transparent polishing pad 120 may generate the frictional force between the semiconductor substrate W and the slurry 400 by the rotational force.

The transparent polishing pad 120 may be provided to transmit the light L. The transparent polishing pad 120 may pass the light L to the lower surface of the semiconductor substrate W. The transparent polishing pad 120 may include a material capable of passing the light L. For example, the transparent polishing pad 120 may include a material such as glass, quartz, fused silica, and/or sapphire.

In example embodiments, the substrate holder 200 may grip and fix the semiconductor substrate W on the substrate support portion 100 so as to be detachably attached to the semiconductor substrate W. The substrate holder 200 may fix and transport the semiconductor substrate W.

The substrate holder 200 may carry the semiconductor substrate W on the transparent polishing pad 120 of the substrate support portion 100. The substrate holder 200 may move on the substrate support portion 100 in a horizontal direction and a vertical direction. The substrate holder 200 may press the semiconductor substrate W in the vertical direction. The substrate holder 200 may pressurize the semiconductor substrate W to increase frictional force between the semiconductor substrate and the slurry 400.

The substrate holder 200 may rotate clockwise or counterclockwise on the substrate support portion 100. The substrate holder 200 may rotate the semiconductor substrate W clockwise or counterclockwise while the semiconductor substrate W is in contact with the transparent polishing pad 120. The substrate holder 200 may increase the frictional force between the slurry 400 and the semiconductor substrate W by rotating the semiconductor substrate W that is in contact with the transparent polishing pad 120. In the polishing process, the transparent polishing pad 120 and the substrate holder 200 may rotate clockwise or counterclockwise to increase the frictional force between the slurry 400 and the semiconductor substrate W. The transparent polishing pad 120 and the substrate holder 200 may rotate in opposite directions to increase the frictional force.

In example embodiments, the slurry supply portion 300 may supply the slurry 400 onto the transparent polishing pad 120. The slurry supply portion 300 may supply the slurry 400 between the semiconductor substrate W and the transparent polishing pad 120. The slurry 400 supplied from the slurry supply portion 300 may be uniformly applied on the transparent polishing pad 120 by the rotational force of the substrate support portion 100.

In example embodiments, the slurry 400 may include a light blocking material 410 blocking the light L, and abrasive particles 420 that are activated by receiving electrons from a photocatalyst 422. The photocatalyst 422 may generate the electrons by the light L. For example, the slurry 400 may have an aqueous solution in an aqueous phase. The slurry 400 may have an aqueous solution in an aqueous acidic phase. The light blocking material 410 and the abrasive particles 420 of the slurry 400 may freely move in the aqueous solution. For example, the abrasive particles 420 may surround a mixture material including the photocatalysts 422.

The slurry 400 may further include a booster that increases polishing strength by adhering to a polishing film of the semiconductor substrate W. The slurry 400 may further include an inhibitor that reduces the polishing strength by adhering to the polishing film quality of the semiconductor substrate W. The booster and the inhibitor may vary depending on a material composition of the polishing film of the semiconductor substrate W.

The light blocking material 410 may block the light L irradiated to the abrasive particles 420. The light blocking material 410 may block the light L to prevent the photocatalysts 422 from generating the electrons. The light blocking material 410 may flow between the protrusions P provided on the lower surface of the semiconductor substrate W. The light blocking material 410 may flow between the uneven shapes of the transparent polishing pad 120. The light blocking material 410 may block the light L between the protrusions P.

For example, the light blocking material 410 may include melanin, chlorophyll, hemoglobin, beta-carotene, and/or carbon black.

The abrasive particles 420 may include the photocatalysts 422. When the photocatalyst 422 is irradiated with the light L, the photocatalysts 422 may generate the electrons, and the abrasive particles 420 may be activated based on the electrons. The activated abrasive particles **420*a* may have high polishing performance. The activated abrasive particles 420*a*** may have a high frictional force with respect to the semiconductor substrate W.

The photocatalysts 422 not irradiated with the light L may not generate the electrons. The abrasive particles 420 not receiving the electrons may be in a non-activated state. The non-activated abrasive particles **420*b* may have low abrasive performance. The non-activated abrasive particles 420*b*** may have a low frictional force with respect to the semiconductor substrate W.

For example, the abrasive particles 420 may include silica ($SiO_2$), alumina ($Al_2O_3$), titanium oxide ($TiO_2$), and/or cerium oxide ($CeO_2$). A particle size of the abrasive particles 420 may be within a range of 5 nm to 20 nm.

The abrasive particles 420 may be activated by the light L at a position adjacent to the transparent polishing pad 120.

At the position adjacent to the transparent polishing pad 120, the light blocking material 410 may not be provided between the protrusions P and the transparent polishing pad 120. The activated abrasive particles 420*a* may polish the protrusions P.

The abrasive particles 420 may not be activated on the bottom surface of the uneven structure of the semiconductor substrate W. The light L may not reach the bottom surface of the uneven structure of the semiconductor substrate W. Non-activated abrasive particles 420*b* may not polish the protrusions P and the bottom surface.

In example embodiments, the abrasive particles 420 may include cerium oxide ($CeO_2$). When the abrasive particles 420 includes cerium oxide, the abrasive particles 420 may accept the electrons to reduce tetravalent cerium ions ($Ce^{4+}$) on a surface of the cerium oxide to trivalent cerium ions ($Ce^{3+}$).

The cerium oxide may accept the electrons and reduce the tetravalent cerium ions ($Ce^{4+}$) to the trivalent cerium ions ($Ce^{3+}$) as shown in below in Equation (1). The trivalent cerium ion may have a higher frictional force than the tetravalent cerium ion on the surface of the cerium oxide.

$$e^- + O_2 \rightarrow O_2^{\cdot -} / e^- + Ce^{4+} \rightarrow O_2 + Ce^{3+}$$

$$e^- + O_2 \rightarrow O_2^-;\ e^- + Ce^{4+} \rightarrow O_2 + Ce^{3+} \qquad \text{Equation (1)}$$

Here, $e^-$ is the electron, $O_2$ is oxygen, $Ce^{4+}$ is the tetravalent cerium ion, and $Ce^{3+}$ is the trivalent cerium ion.

When the light L includes the visible light, the photocatalysts 422 may include a first photocatalyst that reacts to the visible light. The first photocatalyst may generate the electrons in response to the visible light. For example, the first photocatalyst may include a gold/titanium dioxide ($Au/TiO_2$) compound, a titanium dioxide/selenium dioxide ($TiO_2/SeO_2$) compound, and/or a titanium dioxide/silicon dioxide ($TiO_2/SiO_2$) compound.

When the light L includes the ultraviolet light, the photocatalysts 422 may include a second photocatalyst that reacts to the ultraviolet light. The second photocatalyst may generate the electrons in response to the ultraviolet light. For example, the second photocatalyst may include titanium dioxide ($TiO_2$), zinc oxide (ZnO), zirconium oxide ($ZrO_2$), cadmium selenide (CdSe), tungsten trioxide/titanium dioxide ($WO_3/TiO_2$), and/or aluminum oxide/zirconium oxide ($Al_2O_3/ZrO_2$).

In example embodiments, the substrate processing apparatus 10 may further include a pad conditioner 500. The pad conditioner 500 may distribute the slurry 400 on the transparent polishing pad 120. The pad conditioner 500 may restore the surface roughness of the transparent polishing pad 120. The pad conditioner 500 may restore the surface roughness by roughening the surface of the transparent polishing pad 120 with a diamond. The pad conditioner 500 may prevent residue that remains on the transparent polishing pad 120 from interfering with a supply of the slurry 400.

As described above, the slurry 400 may fill between the protrusions P of the semiconductor substrate W where the bottom surface of the semiconductor substrate W is located. The light blocking material 410 of the slurry 400 may block the light L between the substrate support portion 100 and the semiconductor substrate W. Since the light L is blocked by the light blocking material 410, at least some of the photocatalysts 422 of the slurry 400 may not generate the electrons. When the abrasive particles 420 are non-activated, the abrasive particles 420 that are non-activated may not polish the lower surface of the semiconductor substrate W on the bottom surface of the uneven structure.

Also, since surfaces (e.g., bottom surfaces) of the protrusions P of the uneven structure directly contact the substrate support portion 100, the light blocking material 410 may not be provided on such surfaces of the protrusions P. Since such surfaces of the protrusions P do not have the light blocking material 410 thereon, the photocatalysts 422 located on the protrusions P may generate electrons by the light L and the abrasive particles 420 (that is, the activated abrasive particles 420*a*) may polish the protrusions P. Accordingly, the abrasive particles 420 in the slurry 400 may polish the surfaces of the protrusions P of the uneven structure and not polish the bottom surface of the semiconductor substrate that is between the protrusions P. Since the abrasive particles 420 in the slurry 400 polish only the protrusions P of the semiconductor substrate W, a uniform polishing degree may be generated on the lower surface of the semiconductor substrate W.

Hereinafter, a substrate processing method using the substrate processing apparatus in FIG. 1 will be described in detail.

FIGS. 4 to 8 are cross-sectional views illustrating a substrate processing method using the substrate processing apparatus in FIG. 1 in accordance with example embodiments of the present disclosure. FIGS. 5 to 8 are enlarged cross-sectional views illustrating a portion B in FIG. 4 in a process of polishing a semiconductor substrate.

Figure 4:
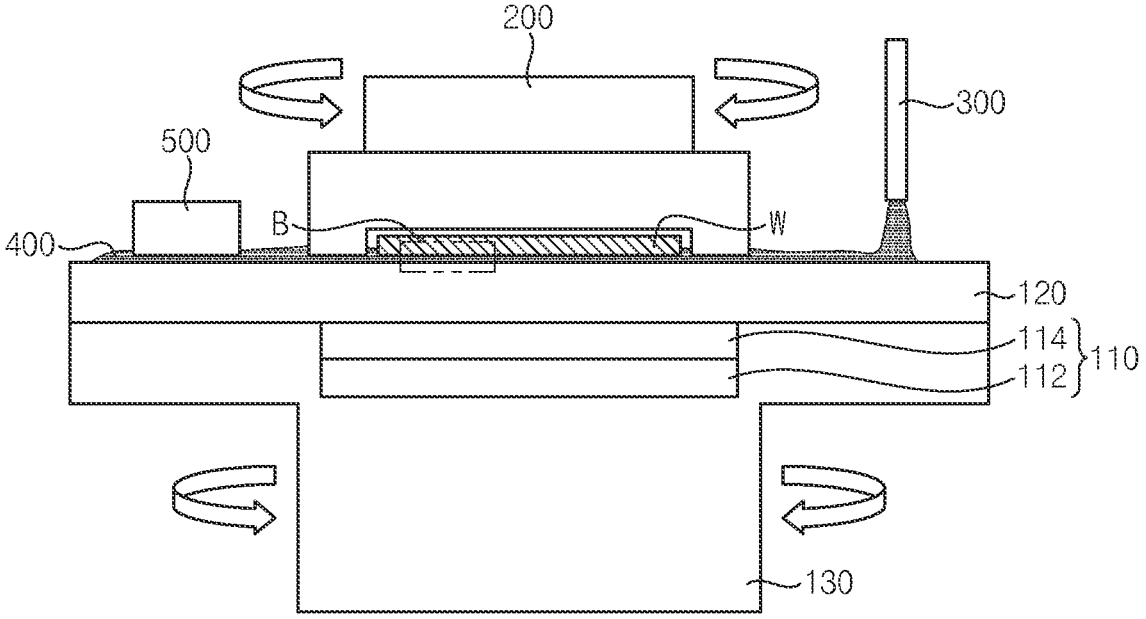

Referring to FIG. 4, a semiconductor substrate W may be arranged on a transparent polishing pad 120 of a substrate support portion 100 (refer to FIG. 1) via a substrate holder 200, and slurry 400 may be supplied through a slurry supply portion 300. The slurry 400 may polish the semiconductor substrate W by being between the semiconductor substrate W and the transparent polishing pad 120.

In example embodiments, the semiconductor substrate W may be arranged on the transparent polishing pad 120. The slurry supply portion 300 may supply the slurry 400 for polishing a lower surface of the semiconductor substrate W by the slurry 400 being between the semiconductor substrate W and the transparent polishing pad 120.

In example embodiments, a platen 110 may rotate clockwise or counterclockwise by a shaft 130. The transparent polishing pad 120 may rotate by receiving rotational force through the platen 110. The rotational force may be generated from the shaft 130. The transparent polishing pad 120 may rotate clockwise or counterclockwise.

The substrate holder 200 may rotate clockwise or counterclockwise on the substrate support portion 100. The substrate holder 200 may rotate the semiconductor substrate W clockwise or counterclockwise while the semiconductor substrate W is in contact with the transparent polishing pad 120. The substrate holder 200 may increase the frictional force between the slurry 400 and the semiconductor substrate W by rotating the semiconductor substrate W in contact with the transparent polishing pad 120. The transparent polishing pad 120 and the substrate holder 200 may rotate clockwise or counterclockwise to increase the frictional force between the slurry 400 and the semiconductor substrate W. The transparent polishing pad 120 and the substrate holder 200 may rotate in opposite directions to increase the frictional force.

Figure 5:
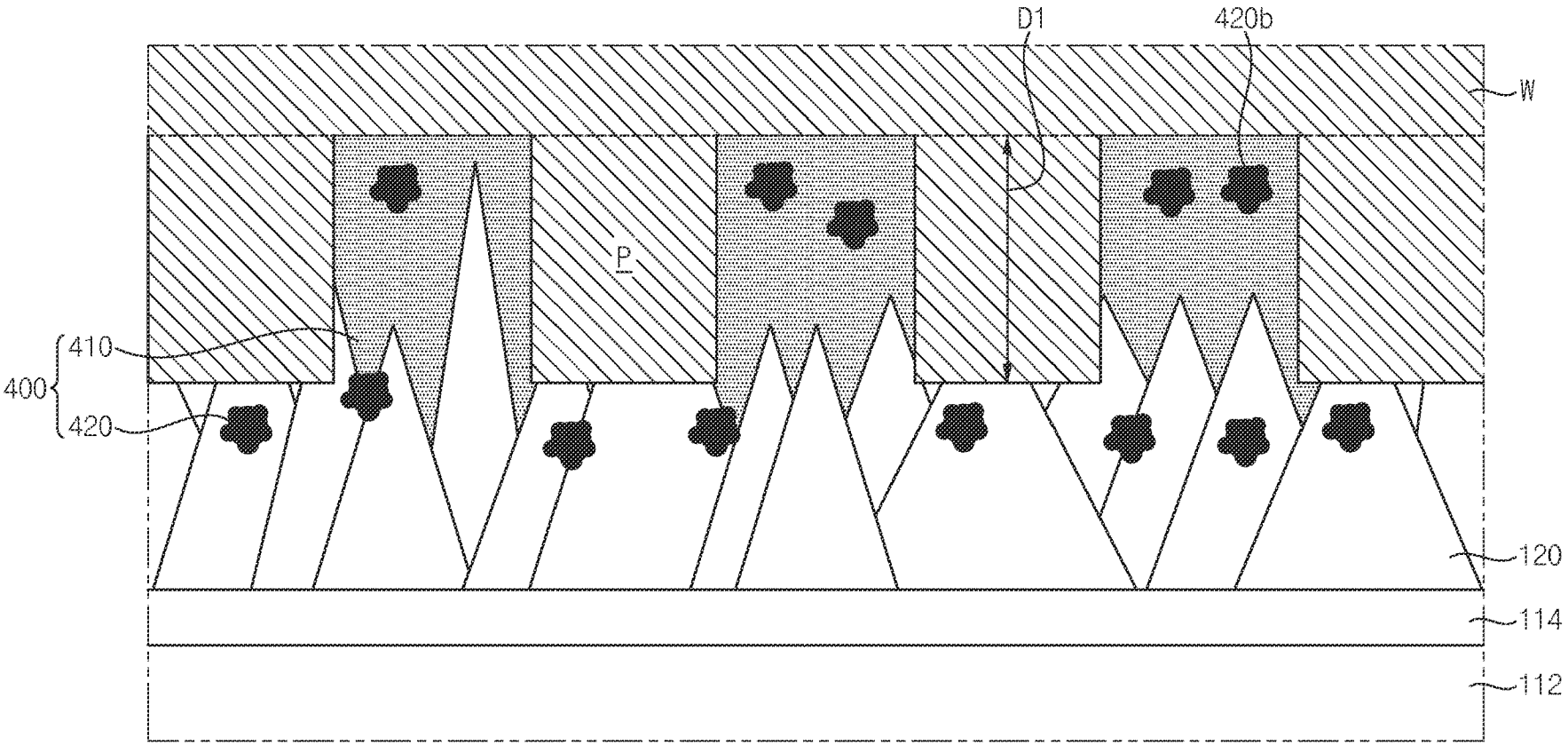

As illustrated in FIG. 5, the semiconductor substrate W may have a fine uneven structure. The uneven structure may be defined by protrusions P that protrude from the lower surface of the semiconductor substrate W. Each of the protrusions P may have a first distance D1 from a bottom surface of the uneven structure. For example, each of the protrusions P may protrude the first distance D1 from the lower surface of the semiconductor substrate W. A polishing degree of the lower surface of the semiconductor substrate W may be determined by the first distance D1. When the first distance D1 is smaller, the lower surface of the semiconductor substrate W may have a more uniform polishing degree.

In example embodiments, the slurry 400 may fill between the protrusions P of the semiconductor substrate W. The slurry 400 may fill a fine surface of the transparent polishing pad 120. The slurry 400 may include a light blocking material 410 blocking a light L, and abrasive particles 420. The abrasive particles 420 may be activated by receiving electrons from a photocatalyst 422. The photocatalyst may generate the electrons by the light L. When the light L is not generated, the photocatalyst 422 of the abrasive particles 420 may not generate the electrons, and the abrasive particles 420 may be non-activated.

Figure 6:
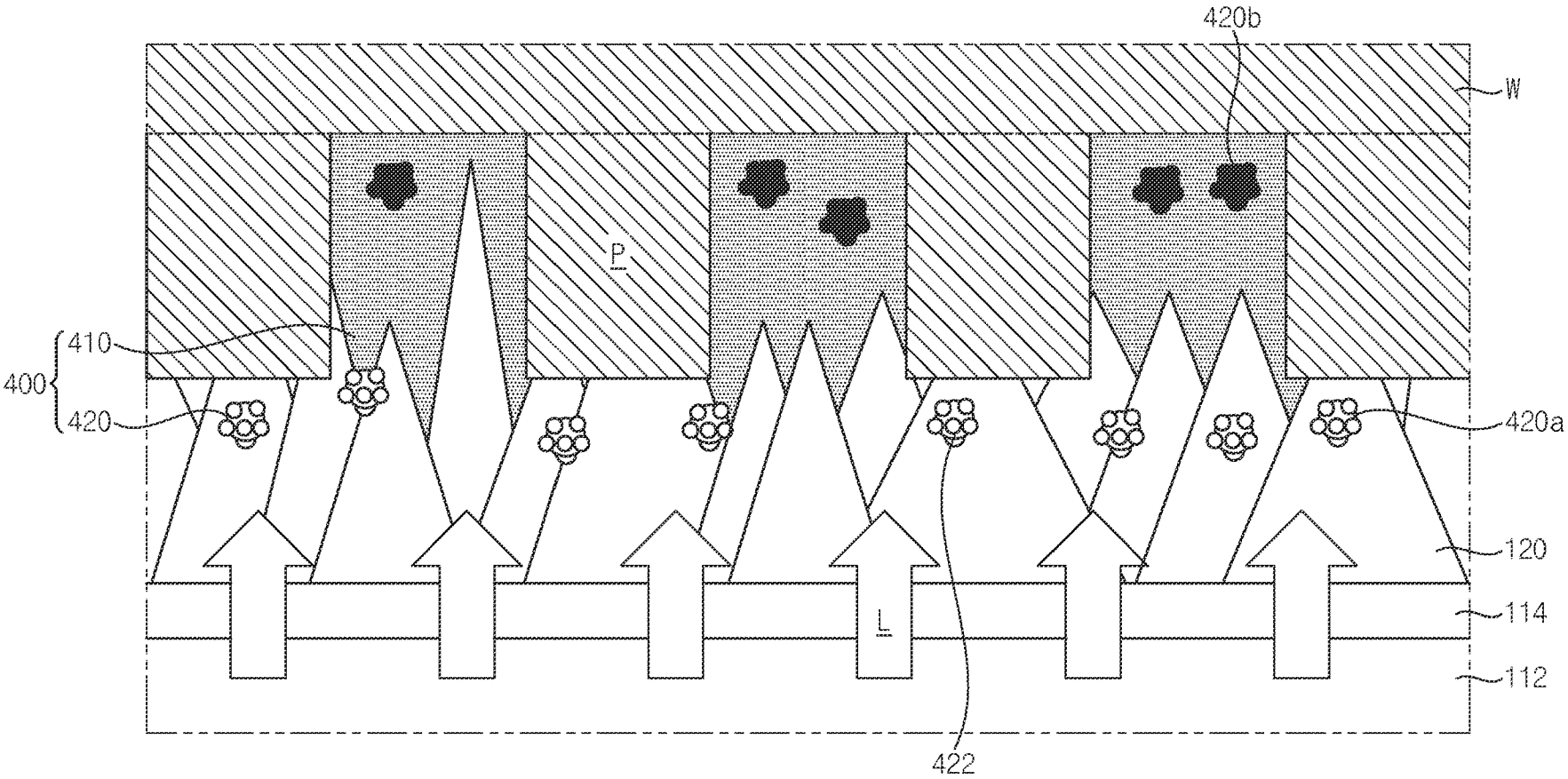
Figure 7:
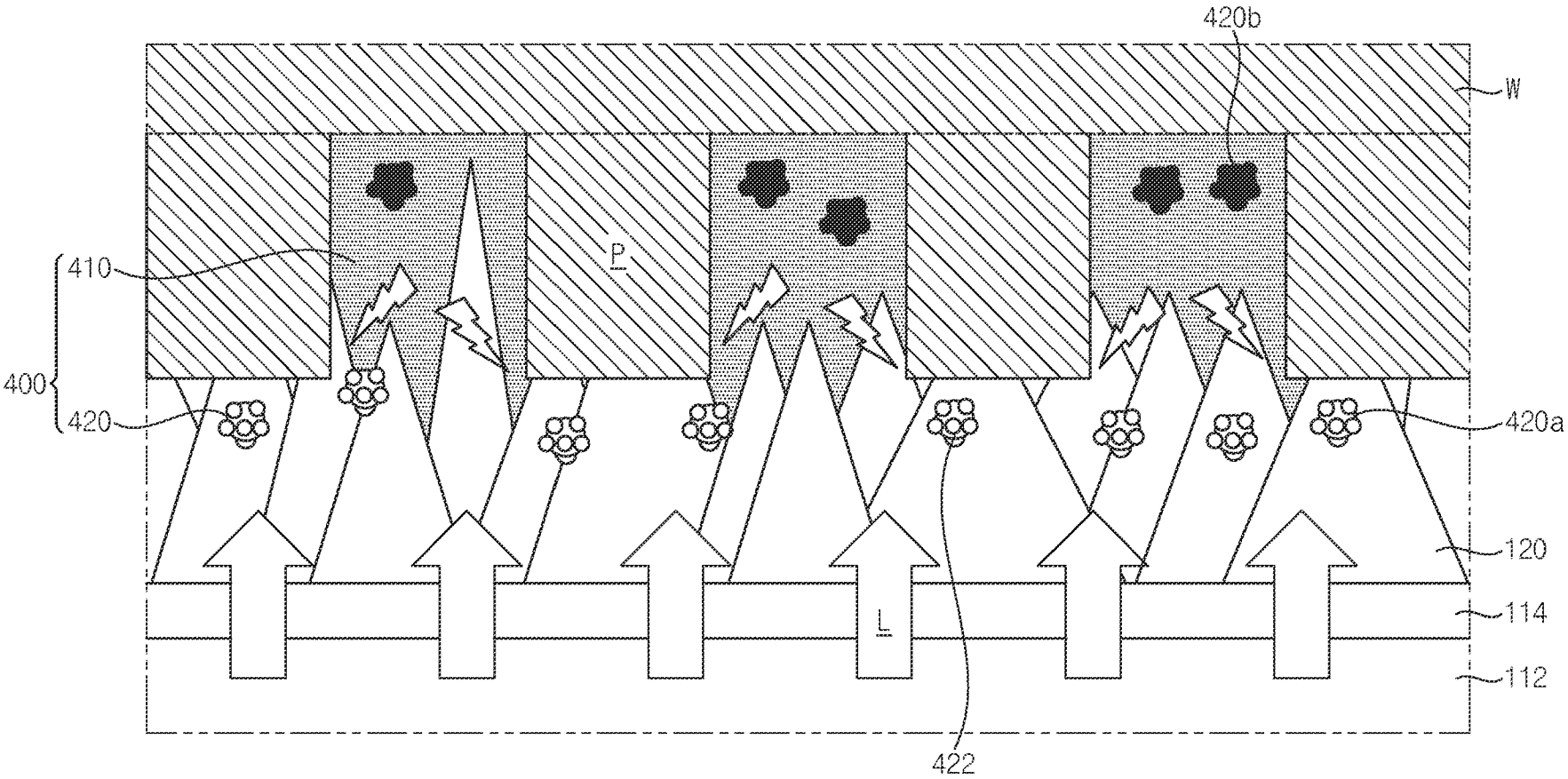

As illustrated in FIGS. 6 and 7, a light generator 112 of the substrate support portion 100 may radiate the light L towards the lower surface of the semiconductor substrate W. The light L may pass through the transparent polishing pad 120, and may be irradiated to the slurry 400.

The abrasive particles 420 positioned on the protrusions P of the semiconductor substrate W may be irradiated with the light L. The photocatalyst 422 of the abrasive particles 420 irradiated with light L may generate the electrons, and the abrasive particles 420 may be activated. The activated abrasive particles 420*a* may have a high polishing performance. The activated abrasive particles 420*a* may have a high frictional force with respect to the semiconductor substrate W. The activated abrasive particles 420*a* may polish the protrusions P of the semiconductor substrate W.

The abrasive particles 420 positioned on the bottom surface of the semiconductor substrate W, between the protrusions P, may not be irradiated by the light L. The light blocking material 410 inside the slurry 400 may block the light L irradiated to the abrasive particles 420. The light blocking material 410 may block the light L to prevent activation of the photocatalyst 422.

The abrasive particles 420 that do not receive the electrons from the photocatalyst 422 may be non-activated. The non-activated abrasive particles 420*b* may have a low abrasive performance. The non-activated abrasive particles 420*b* may have a low frictional force on the bottom surface of the uneven structure of the semiconductor substrate W. The non-activated abrasive particles 420*b* may not polish the protrusions P of the semiconductor substrate W and the bottom surface of the semiconductor substrate W.

The activated abrasive particles 420*a* may have the high frictional force on the protrusions P and, may polish the protrusions P. Also, the non-activated abrasive particles 420*b* may have the low frictional force on the bottom surface of the uneven structure, and may not polish the bottom surface. Accordingly, the abrasive particles 420 may have different frictional forces depending on a distance from the transparent polishing pad 120. The abrasive particles 420 may selectively polish the protrusions P of the semiconductor substrate W.

Figure 8:
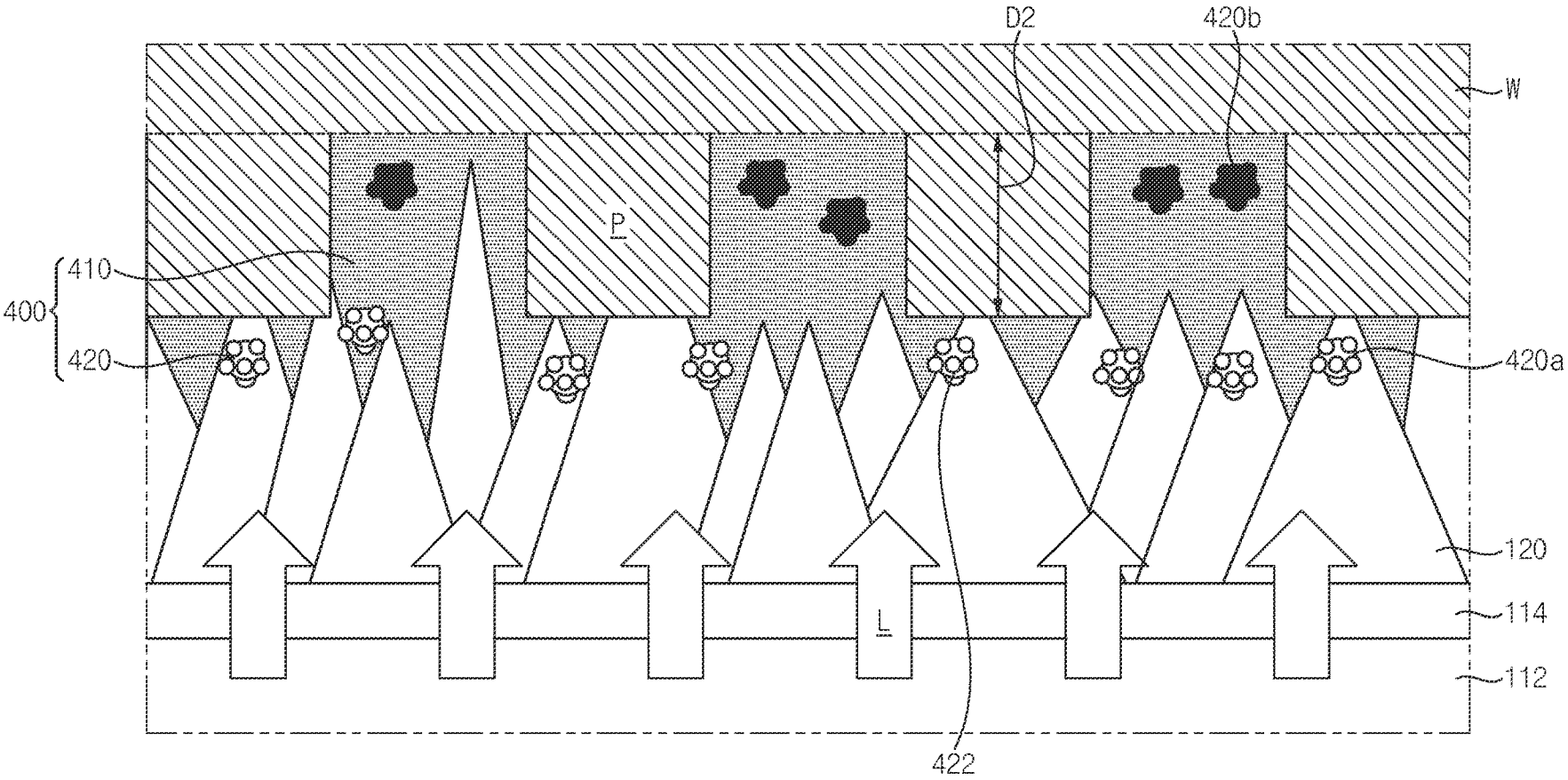

As illustrated in FIG. 8, the activated abrasive particles 420*a* may polish the protrusions P. The protrusions P that are polished may have a second distance D2 that is smaller than the first distance D1 from the bottom surface of the semiconductor substrate W. Since the second distance D2 is smaller than the first distance D1 of the protrusions P, the lower surface of the semiconductor substrate W may have a uniform polishing degree. As the protrusions P are polished, additional ones of the abrasive particles 420 may be activated, and the abrasive particles 420 may uniformly polish the lower surface of the semiconductor substrate W.

The foregoing is illustrative of example embodiments and is not to be construed as limiting thereof. Although a few example embodiments have been described, those skilled in the art will readily appreciate that many modifications are possible in example embodiments without materially departing from the novel teachings and advantages of the present disclosure. Accordingly, all such modifications are intended to be included within the scope of the present disclosure.

What is claimed is:

1. A substrate processing apparatus comprising:

a substrate support portion comprising a platen and a transparent polishing pad on the platen, the platen comprising a light generator configured to generate light that passes through the transparent polishing pad and proceeds towards a semiconductor substrate on the substrate support portion, and the transparent polishing pad comprising a transparent surface that is configured to contact and polish the semiconductor substrate;

a substrate holder configured to fix the semiconductor substrate such that the semiconductor substrate is in contact with the substrate support portion, and the substrate holder is further configured to contact the transparent surface of the transparent polishing pad and a surface of the semiconductor substrate, and polish the surface of the semiconductor substrate via the transparent polishing pad; and a slurry supplier comprising a slurry and configured to supply the slurry between the semiconductor substrate and the transparent polishing pad, wherein the slurry comprises:

a light blocking material that is configured to block the light; and abrasive particles that are configured to be activated by accepting electrons generated, based on the light, by a photocatalyst within the slurry, and wherein the light generator is configured to uniformly radiate the light towards the semiconductor substrate, across the surface of the semiconductor substrate, such that the light passes through the transparent surface of the transparent polishing pad, causes the photocatalyst to generate the electrons, and is blocked by the light blocking material, wherein the semiconductor substrate has an uneven structure comprising a bottom surface and protrusions protruding from the bottom surface, wherein the slurry supplier is configured to supply the slurry such that the light blocking material is between the protrusions, the light blocking material configured to block the light from being irradiated to the photocatalyst, which is between the protrusions, thereby preventing the photocatalyst between the protrusions from generating electrons and preventing the abrasive particles, which are between the protrusions, from being activated by accepting electrons, and wherein the abrasive particles between the protrusions and the transparent polishing pad are configured to be activated such that the abrasive particles polish the protrusions.

2. The substrate processing apparatus of claim 1, wherein the abrasive particles further comprise cerium oxide ($CeO_2$).

3. The substrate processing apparatus of claim 2, wherein the abrasive particles are configured to be activated by accepting the electrons generated by the photocatalyst such that tetravalent cerium ions ($Ce^{4+}$) on a surface of the cerium oxide are reduced to trivalent cerium ions ($Ce^{3+}$).

4. The substrate processing apparatus of claim 1, further comprising:

a pad conditioner configured to dispense the slurry on the substrate support portion and roughen the transparent surface of the transparent polishing pad to maintain the transparent polishing pad with a constant surface roughness capable of polishing the semiconductor substrate.

5. The substrate processing apparatus of claim 1, wherein the substrate holder is configured to rotate the semiconductor substrate clockwise or counterclockwise on the substrate support portion.

6. The substrate processing apparatus of claim 1, wherein the platen is configured to rotate the transparent polishing pad clockwise or counterclockwise.

7. The substrate processing apparatus of claim 1, wherein the light blocking material comprises at least one from among melanin, chlorophyll, hemoglobin, beta-carotene, and carbon black.

8. The substrate processing apparatus of claim 1, wherein the light comprises visible light, and the photocatalyst comprises at least one from among a gold/titanium dioxide ($Au/TiO_2$) compound, a titanium dioxide/selenium dioxide ($TiO_2/SeO_2$) compound, and a titanium dioxide/silicon dioxide ($TiO_2/SiO_2$) compound.

9. The substrate processing apparatus of claim 1, wherein the light comprises ultraviolet light, and the photocatalyst comprises at least one from among titanium dioxide ($TiO_2$), zinc oxide (ZnO), zirconium oxide ($ZrO_2$), cadmium selenide (CdSe), tungsten trioxide/titanium dioxide ($WO_3/TiO_2$), and aluminum oxide/zirconium oxide ($Al_2O_3/ZrO_2$).

10. The substrate processing apparatus of claim 1, wherein the light generator comprises a lamp.

11. A substrate processing apparatus, comprising:

a platen comprising a light generator configured to generate light, and an optical window configured to allow the light to pass therethrough;

a transparent polishing pad on the platen, the transparent polishing pad comprising an upper transparent surface configured to contact and polish a semiconductor substrate, wherein the light generator is configured to generate the light such that the light passes through the transparent polishing pad and proceeds towards the semiconductor substrate;

a substrate holder configured to fix the semiconductor substrate on the transparent polishing pad and press a surface of the semiconductor substrate onto the upper transparent surface of the transparent polishing pad;

a slurry supplier comprising a slurry and configured to supply the slurry between the semiconductor substrate and the transparent polishing pad, the slurry comprising a light blocking material that is configured to block the light, and the slurry further comprising abrasive particles that are configured to be activated by accepting electrons generated, based on the light, by a photocatalyst within the slurry; and a pad conditioner configured to distribute the slurry in a horizontal direction on the transparent polishing pad, wherein the light generator is configured to uniformly radiate the light towards the semiconductor substrate, across the surface of the semiconductor substrate, such that the light passes through the upper transparent surface of the transparent polishing pad, causes the photocatalyst to generate the electrons, and is blocked by the light blocking material, wherein the semiconductor substrate has an uneven structure comprising a bottom surface and protrusions protruding from the bottom surface, wherein the slurry supplier is configured to supply the slurry such that the light blocking material is between the protrusions, the light blocking material configured to block the light from being irradiated to the photocatalyst, which is between the protrusions, thereby preventing the photocatalyst between the protrusions from generating electrons and preventing the abrasive particles, which are between the protrusions, from being activated by accepting electrons, and wherein the abrasive particles between the protrusions and the transparent polishing pad are configured to be activated such that the abrasive particles polish the protrusions.

12. The substrate processing apparatus of claim 11, wherein the abrasive particles further comprise cerium oxide ($CeO_2$).

13. The substrate processing apparatus of claim 12, wherein the abrasive particles are configured to be activated by accepting the electrons generated by the photocatalyst such that tetravalent cerium ions ($Ce^{4+}$) on a surface of the cerium oxide are reduced to trivalent cerium ions ($Ce^{3+}$).

14. The substrate processing apparatus of claim 11, wherein the substrate holder is configured to rotate the semiconductor substrate clockwise or counterclockwise on the transparent polishing pad.

15. The substrate processing apparatus of claim 11, wherein the platen is configured to rotate the transparent polishing pad clockwise or counterclockwise.

16. The substrate processing apparatus of claim 11, wherein the light blocking material comprises at least one from among melanin, chlorophyll, hemoglobin, beta-carotene, and carbon black.

17. The substrate processing apparatus of claim 11, wherein the light comprises visible light, and the photocatalyst comprises at least one from among a gold/titanium dioxide ($Au/TiO_2$) compound, a titanium dioxide/selenium dioxide ($TiO_2/SeO_2$) compound, and a titanium dioxide/silicon dioxide ($TiO_2/SiO_2$) compound.

18. The substrate processing apparatus of claim 11, wherein the light comprises ultraviolet light, and the photocatalyst comprises at least one from among titanium dioxide ($TiO_2$), zinc oxide (ZnO), zirconium oxide ($ZrO_2$), cadmium selenide (CdSe), tungsten trioxide/titanium dioxide ($WO_3/TiO_2$), and aluminum oxide/zirconium oxide ($Al_2O_3/ZrO_2$).

19. The substrate processing apparatus of claim 11, wherein the substrate holder is configured to contact the upper transparent surface of the transparent polishing pad and the surface of the semiconductor substrate such that an entire width, in the horizontal direction, of the surface of the semiconductor substrate overlaps with the optical window in a vertical direction.

20. A substrate processing apparatus comprising:

a substrate support portion that comprises a platen and a transparent polishing pad on the platen, the platen comprising a light generator configured to generate light that passes through the transparent polishing pad and proceeds towards a semiconductor substrate on the substrate support portion, and the transparent polishing pad comprising a transparent surface that is configured to contact and polish the semiconductor substrate;

a substrate holder configured to fix the semiconductor substrate such that the semiconductor substrate is in contact with the substrate support portion, and the substrate holder is further configured to contact the transparent surface of the transparent polishing pad and a surface of the semiconductor substrate, and polish the surface of the semiconductor substrate via the transparent polishing pad;

a slurry supplier comprising a slurry and configured to supply the slurry between the semiconductor substrate and the transparent polishing pad, the slurry comprising a light blocking material that is configured to block the light, and the slurry further comprising abrasive particles that are configured to be activated by electrons generated, based on the light, by a photocatalyst within the slurry; and a pad conditioner configured to dispense the slurry on the substrate support portion and roughen the transparent surface of the transparent polishing pad to maintain the transparent polishing pad with a constant surface roughness capable of polishing the semiconductor substrate, wherein the abrasive particles further comprise cerium oxide ($CeO_2$), and the abrasive particles are configured to be activated by the electrons generated by the photocatalyst such that tetravalent cerium ions ($Ce^{4+}$) on a surface of the cerium oxide are reduced to trivalent cerium ions ($Ce^{3+}$), and wherein the light generator is configured to uniformly radiate the light towards the semiconductor substrate, across the surface of the semiconductor substrate, such that the light passes through the transparent surface of the transparent polishing pad, causes the photocatalyst to generate the electrons, and is blocked by the light blocking material, wherein the semiconductor substrate has an uneven structure comprising a bottom surface and protrusions protruding from the bottom surface, wherein the slurry supplier is configured to supply the slurry such that the light blocking material is between the protrusions, the light blocking material configured to block the light from being irradiated to the photocatalyst, which is between the protrusions, thereby preventing the photocatalyst between the protrusions from generating electrons and preventing the abrasive particles, which are between the protrusions, from being activated by accepting electrons, and wherein the abrasive particles between the protrusions and the transparent polishing pad are configured to be activated such that the abrasive particles polish the protrusions.

* * * * *